US007703592B2

(12) United States Patent
Yu et al.

(10) Patent No.: US 7,703,592 B2
(45) Date of Patent: Apr. 27, 2010

(54) BILL ACCETOR WITH IMPROVED FACE PANEL

(75) Inventors: Cheng-Kang Yu, Taipei (TW); Wei-Jr Chen, Taipei (TW); Shih-Chia Chen, Taichung Hsien (TW)

(73) Assignee: International Currency Technologies Corporation, Taipei (TW)

( * ) Notice: Subject to any disclaimer, the term of this patent is extended or adjusted under 35 U.S.C. 154(b) by 1 day.

(21) Appl. No.: 12/127,840

(22) Filed: May 28, 2008

(65) Prior Publication Data

US 2009/0294242 A1 Dec. 3, 2009

(51) Int. Cl.
*G07D 13/00* (2006.01)

(52) U.S. Cl. ..... 194/206; 194/351

(58) Field of Classification Search ..... 194/351, 194/206

See application file for complete search history.

(56) References Cited

U.S. PATENT DOCUMENTS 1,259,605 A * 3/1918 Copeland ..... 194/39
5,964,336 A * 10/1999 Itako et al. ..... 194/207
6,066,010 A * 5/2000 Wulff ..... 439/874
2002/0125627 A1 * 9/2002 Hand ..... 271/10.01

* cited by examiner

*Primary Examiner*—Patrick Mackey
*Assistant Examiner*—Mark Beauchaine
(74) *Attorney, Agent, or Firm*—Muncy, Geissler, Olds & Lowe, PLLC

(57) ABSTRACT

A bill acceptor includes a main body attached with a bill box at the back side, a transmission mechanism for carrying a bill or license into a passage in the main body for examination by a recognition unit inside the main body and returning the rejected bill or examined license and carrying the examined bill to the bill box, and a face panel, which is fastened to the front side of the main body and has an insertion slot for the insertion of a bill/license into the passage and a finger guide portion disposed at one lateral side of the insertion slot for the insertion of a finger to bias a jammed license out of the insertion slot.

18 Claims, 8 Drawing Sheets

BILL ACCETOR WITH IMPROVED FACE PANEL

BACKGROUND OF THE INVENTION

1. Field of the Invention

The present invention relates to a bill acceptor for use in an automatic vending machine and more specifically, to a design of face panel for bill acceptor that has a finger guide portion for the insertion of a finger to bias a jammed license out of the insertion slot.

2. Description of the Related Art

Following fast development of technology, our mode of living has been changed, and everything requires efficiency, time saving and quickness. In consequence, different automatic vending machines are used everywhere to sell different products without serviceman. These automatic vending machines are highly invited for the advantage of saving much labor and bringing convenience to people. Nowadays, Q-shops are seen in many places to provide different services to consumers. A Q-shop has the advantages of scientific intelligence, quick service and quick finish of payment. A Q-shop may provide automatic vending machines for vending drinks, cigarettes, tickets, ice creams, memorial coins, key rings, or even hamburgers and noodles. Further, many virtual shops are established to make online shopping, allowing shoppers to shop across millions of products.

However, regular vending machines do not limit the sales to any person of any age. Therefore, regular vending machines commonly sell popular goods such as fruit juice, beverages, carbonated beverages, food, etc. These vending machines cannot sell age-controlled merchandises, such as cigarettes or alcohol drinks, or other controlled merchandises, such as drugs, strong acid/alkaline detergent or other hazardous items. To prohibit young children from buying age-controlled merchandises or unqualified people from buying controlled items, a vending machine for vending age-controlled or controlled merchandises must be equipped with a license recognition device to recognize the age and identity of the user. Before insertion of a bill into the insertion slot on the face panel of the machine, the user must insert a license (driver's license, ID card, insurance card, etc.) into the same insertion slot for enabling the license recognition device to recognize the age and identity of the user. After the age (for example, over 18 years old) and identity of the user has been checked, the user is allowed to insert a bill into the insertion slot to make a trade.

When inserting a bill or license into the insertion slot of the machine, the bill or license must be kept a smooth condition. When inserting a wrinkled bill or license, the bill or license will be rejected by the vending machine. Further, because there are differences in length, if the power supply or vending machine fails upon insertion of a bill or license into the insertion slot of a vending machine, the inserted bill or license may be jammed inside the insertion slot and cannot be retrieved directly, complicating the maintenance work. A push-push mechanism may be installed in the insertion slot to eliminate this problem. When a bill or license is jammed in the insertion slot or the front side of the transmission mechanism, the push-push mechanism can be operated to return the inserted bill or license. However, because the width of the insertion slot is simply slightly greater than the width of the acceptable bill, there is no room for the push-push mechanism, and therefore the push-push mechanism must be installed in the bill passage. In order to accommodate the push-push mechanism, the bill passage must be widened. However, widening the bill passage may complicate the alignment of the inserted bill or license and relatively lower the security level of the machine. Further, because the push-push mechanism has a complicated structure comprised of a number of component parts, the installation of the push-push mechanism greatly increases the cost of the vending machine.

Further, when inserting a bill or license into the insertion slot of a vending machine, the user must aim the bill or license at the insertion slot accurately. During the daylight or under a bright environment, it is easy to aim a bill or license at the insertion slot of a vending machine and then to insert the bill or license into the insertion slot accurately. However, it is inconvenient to smoothen a wrinkled bill or license and then to insert the bill or license into the insertion slot of a vending machine during the night or under a dim environment.

Therefore, it is desirable to provide an automatic vending machine that eliminates the aforesaid problems.

SUMMARY OF THE INVENTION

The present invention has been accomplished to provide a bill acceptor that eliminates the aforesaid problems. According to one aspect of the present invention, the bill acceptor comprises a main body and a face panel. The face panel is fastened to the front side of the main body, comprising an insertion slot disposed in communication with the passage defined in the main body for the insertion of a bill/license into the passage for examination, and a finger guide portion disposed at one lateral side of the insertion slot and defining a tapered finger groove for the insertion of a finger to bias a jammed license out of the insertion slot.

According to another aspect of the present invention, the face panel comprises an indicator formed on the front side of the finger guide portion to guide the insertion of a license along one lateral side of the insertion slot into the passage inside the main body. Further, the indicator can be directly molded on the finger guide portion, showing a different color relative to the finger guide portion. Alternatively, the indicator can be a pattern, a color mark and a word formed on the finger guide portion by means of laser engraving, transfer printing or color etching. Further, the indicator can be formed of a fluorescent material.

According to still another aspect of the present invention, the face panel comprises an opening, a mounting groove disposed at one lateral side of the opening for the mounting of the finger guide portion, and a guide frame fastened to the opening and defining the insertion slot within the opening. Further, the main body has mounted therein a lighting module corresponding to the guide frame. The guide frame can be made out of a transparent or translucent material with different color, or have a part transparent for the passing of light to guide the insertion of a license in the correct direction with the anti-counterfeit characteristics and character data of the inserted license facing upwards or downwards. The lighting module comprises at least one light emitting device, and a lens set between the at least one light emitting device and the guide frame. When at night or when it is dark, the light emitting device of the lighting module emits light through the lens toward the guide frame, illuminating the area around the insertion slot so that a user can insert a bill or license through the insertion slot into the passage in the main body conveniently and accurately.

DETAILED DESCRIPTION OF THE PREFERRED EMBODIMENT

Figure 1:
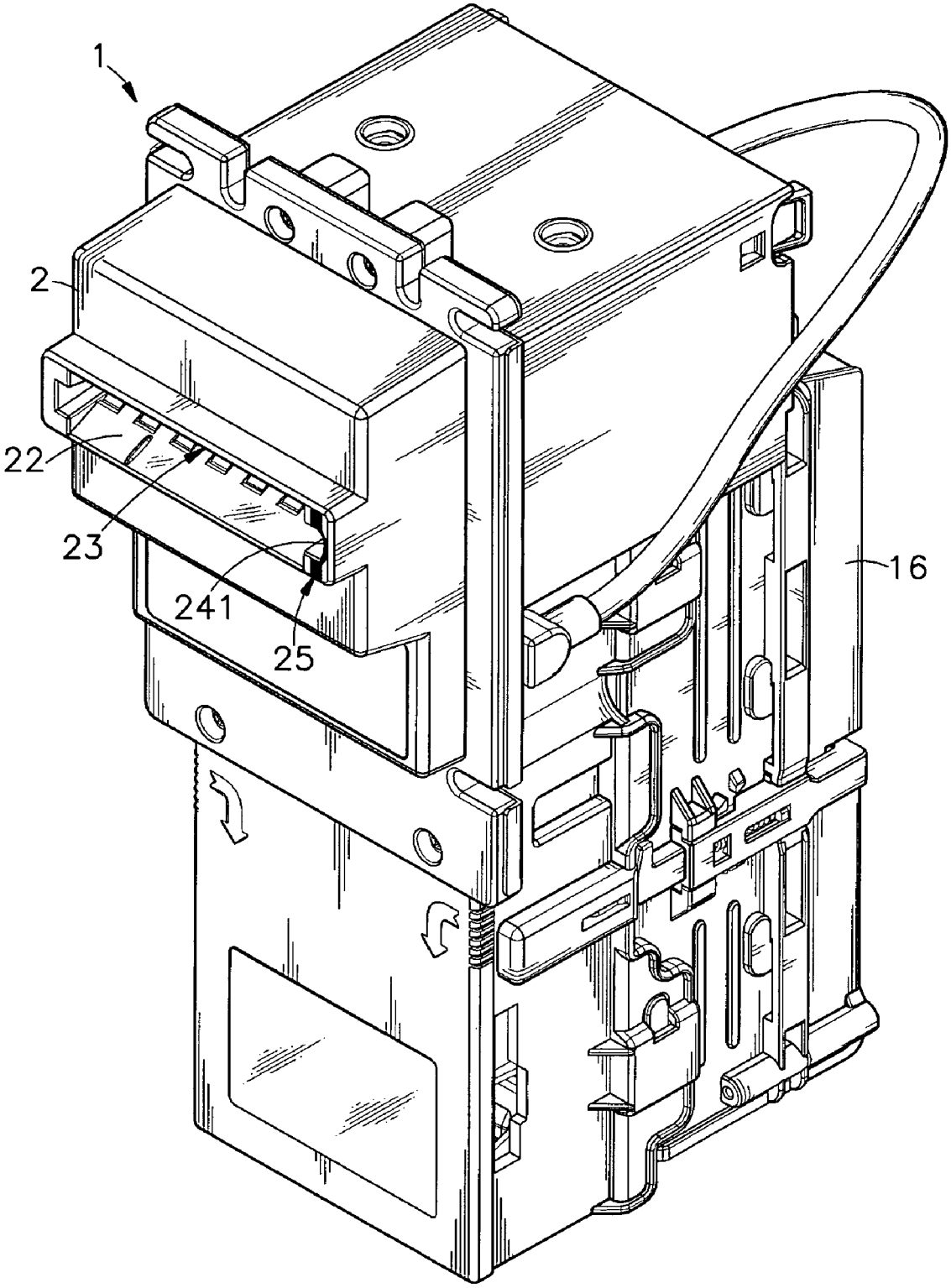
FIG. 1 is an elevational view of a bill acceptor in accordance with the present invention.
Figure 2:
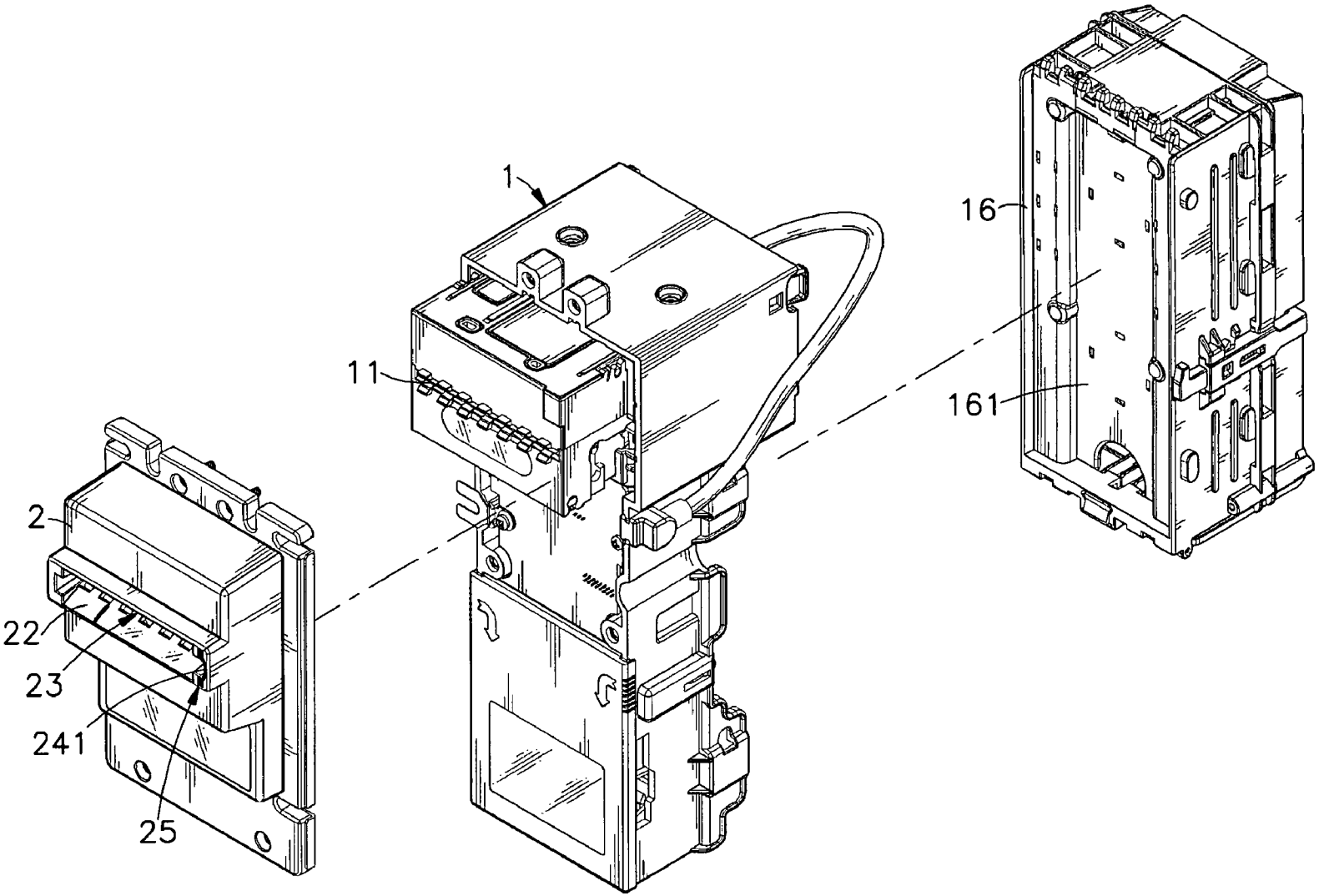
FIG. 2 is an exploded view of the bill acceptor in accordance with the present invention.
Figure 3:
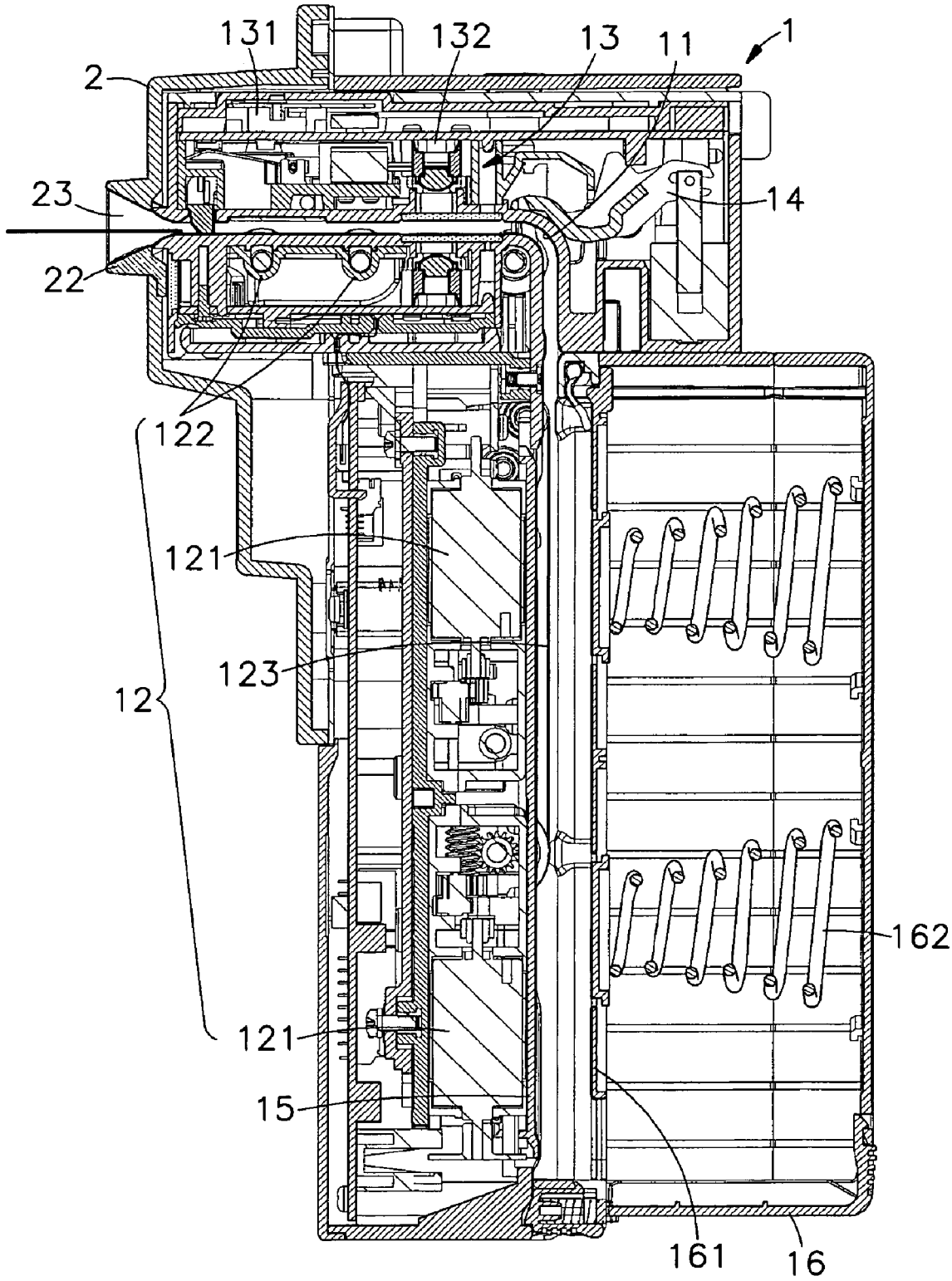
FIG. 3 is a sectional side view of the bill acceptor in accordance with the present invention.
Figure 4:
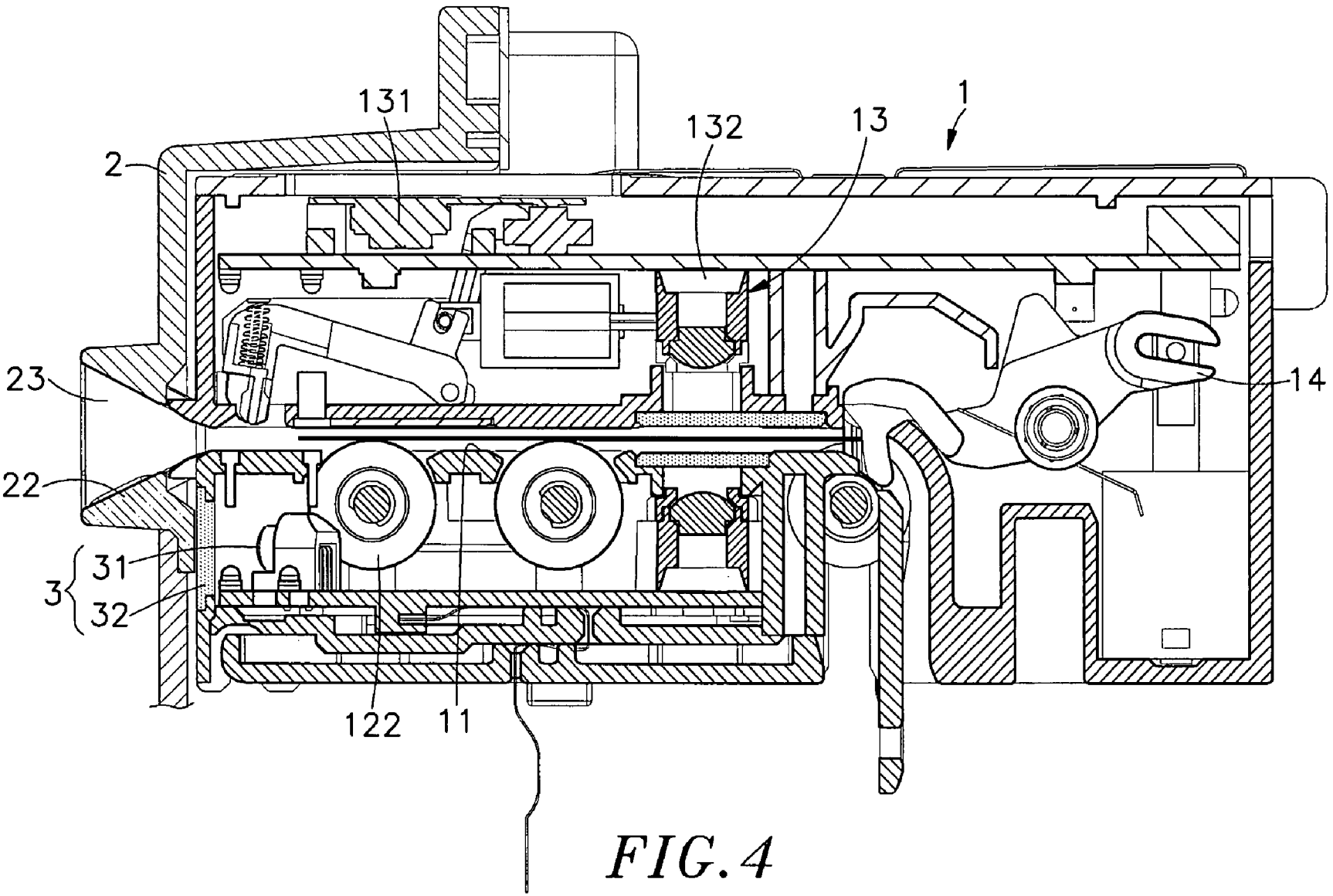
FIG. 4 is an enlarged view of a part of FIG. 3.
Figure 5:
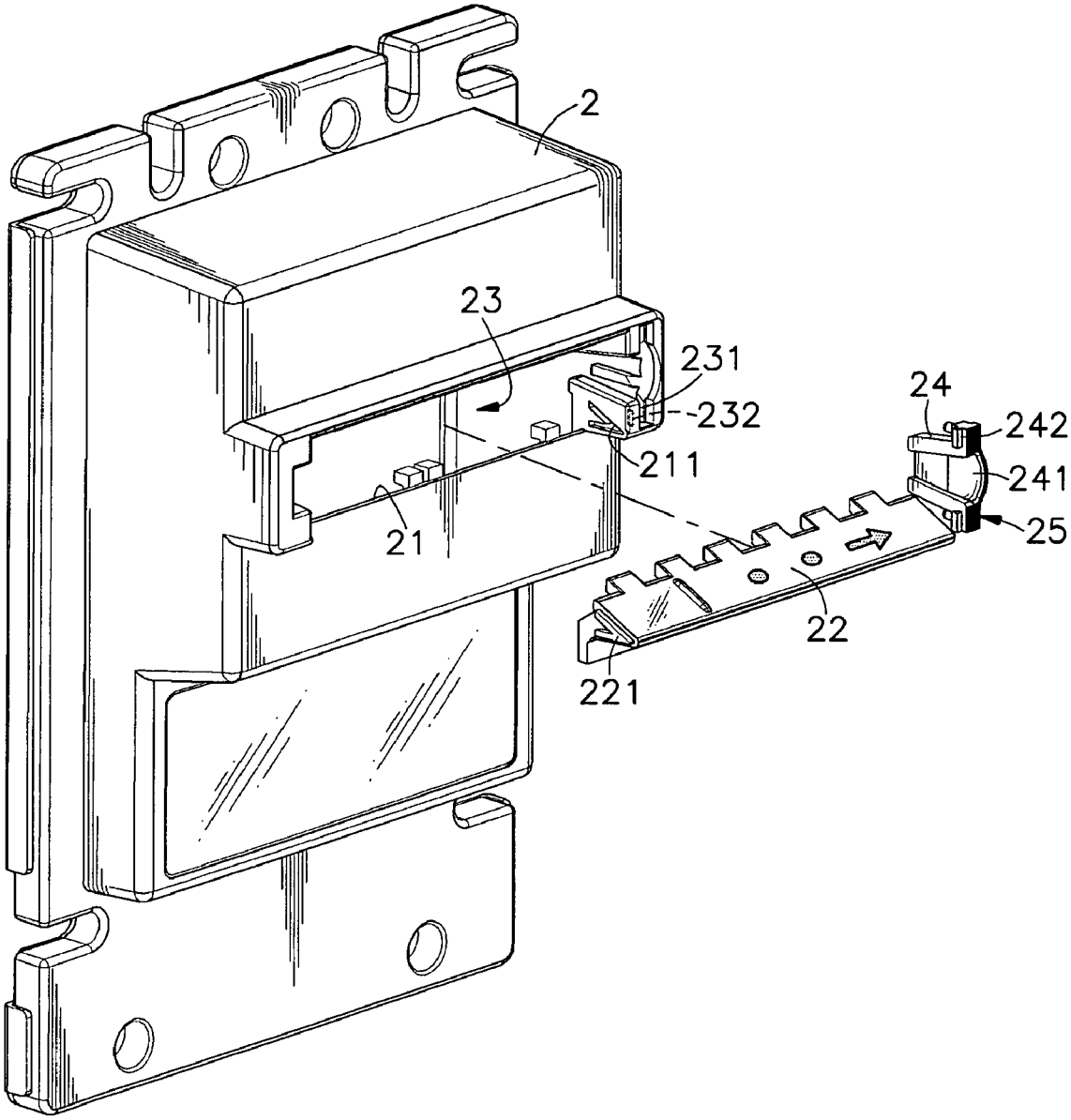
FIG. 5 is an exploded view of the face panel according to the present invention.

Referring to FIGS. 1-5, a bill acceptor in accordance with the present invention is shown comprising a main body 1, a face panel 2 and a lighting module 3.

The main body 1 comprises a passage 11 for the passing of an inserted bill 4 or license 5, a transmission mechanism 12, which is disposed around the passage 11 and comprised of a reversible motor 121, a set of bill-transfer rollers 122 and transmission belts 123 and controllable to move each inserted bill 4 or license 5 into the passage 11 to a predetermined examination position for examination, to return each inserted bill 4 or license 5, or to move each examined bill 4 through the passage 11, and a recognition unit 13 provided at top and bottom sides of the passage 11. The recognition unit 13 comprises a sampling module 131 and an optical identification module 132. The sampling module 131 is adapted for reading and identifying anti-counterfeit characteristics and character data of an inserted license 5. The optical identification module 132 is adapted for identifying the authenticity and value of each inserted bill 4. When an inserted bill 4 is identified, it is carried by the transmission mechanism 12 over an anti-theft hook 14 in a middle turn of the passage 11 toward a bill-pressing device 15 at one side of the rear end of the passage 11.

The main body 1 further has a bill box 16 attached to the back side around the rear end of the passage 11 and opposite to the bill-pressing device 15.

The bill box 16 comprises a bill-bearing board 161 and spring members 162 that supports the bill-bearing board 161. The spring members 162 impart a pressure to the bill-bearing board 161 in direction toward the passage 11 and the bill-pressing device 15. The bill-bearing board 161 is adapted for receiving each bill 4 that is moved out of the passage 11 by the bill-pressing device 15. After pushed an inserted bill 4 transversely away from the passage 11 to the bill-bearing board 161 against the spring members 162, the bill-pressing device 15 is returned, and then the spring members 162 immediately return the bill-bearing board 161, thereby holding the received bill 4 in between the bill-bearing board 161 and the flange around the front open side (not shown) of the bill box 16.

The face panel 2 has an opening 21, a mounting groove 231 at one lateral side of the opening 21, two V-shaped locating grooves 211 disposed at two opposite lateral sides relative to the opening 21, and two retaining holes 232 disposed adjacent to the mounting groove 231 at different elevations. A guide frame 22 is mounted in the opening 21, thereby defining an insertion slot 23 within the opening 21. The guide frame 22 has a finger guide portion 24 disposed at one lateral side and inserted into the mounting groove 231, a tapered finger groove 241 defined in the finger guide portion 24 in communication with the insertion slot 23, two V-shaped locating ribs 221 respectively engaged into the V-shaped locating grooves 211, two retaining blocks 242 respectively engaged into the retaining holes 232, and an indicator 25 at the front side of the finger guide portion 24. The indicator 25 can be a colored mark directly formed on the front side of the finger guide portion 24.

The lighting module 3 is mounted in the main body 1 beneath the front side of the passage 11 corresponding to the guide frame 22, comprising at least one light emitting device 31 and a lens 32. The lens 32 is set between the at least one light emitting device 31 and the guide frame 22 for guiding light in one direction evenly toward the guide frame 22. The light emitting device 31 can be a full color LED (light emitting diode), a high brightness LED or laser LED of any color.

Figure 6:
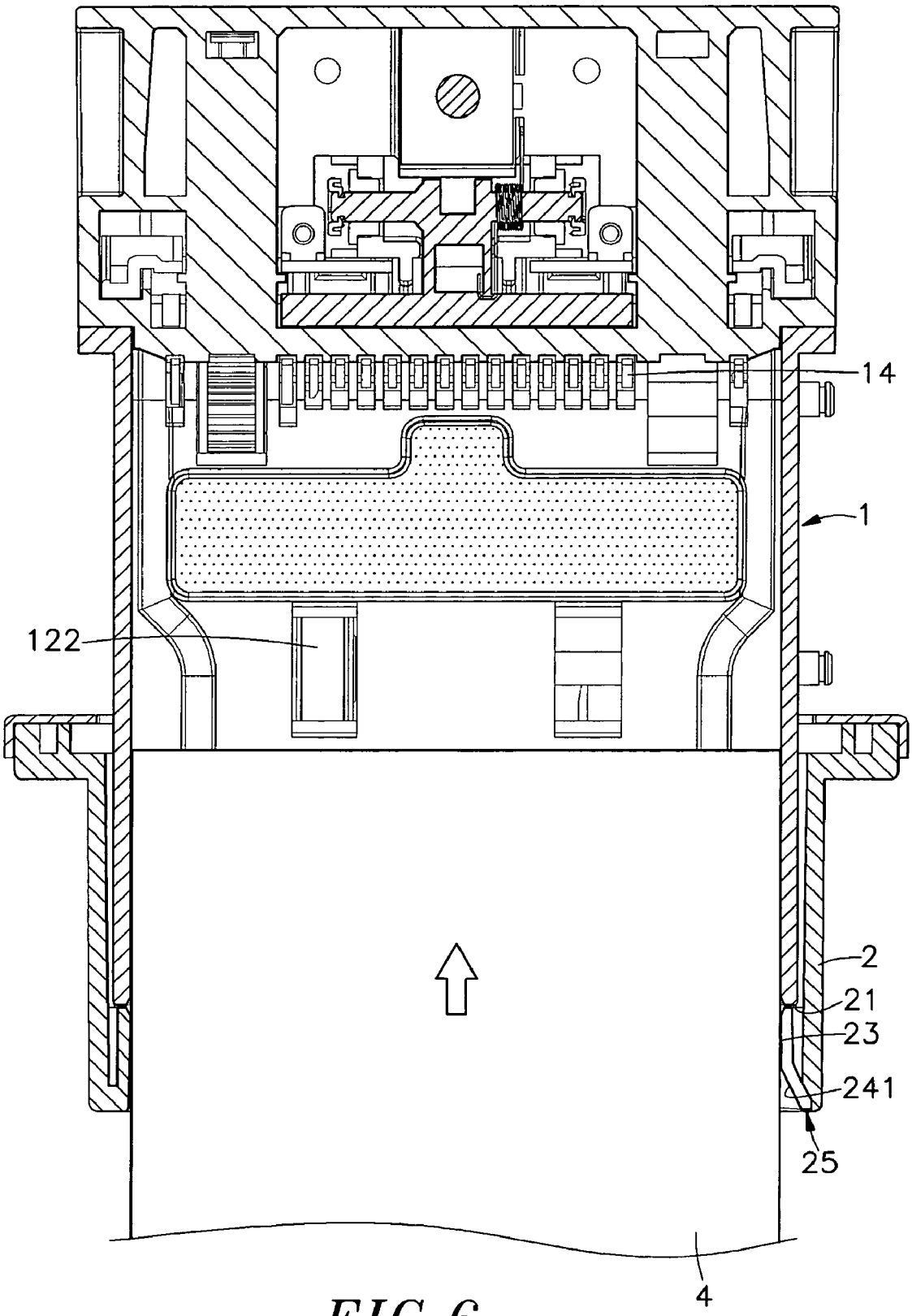
FIG. 6 is a schematic top view of the present invention, showing a bill inserted through the insertion slot into the passage of the main body of the bill acceptor.
Figure 7:
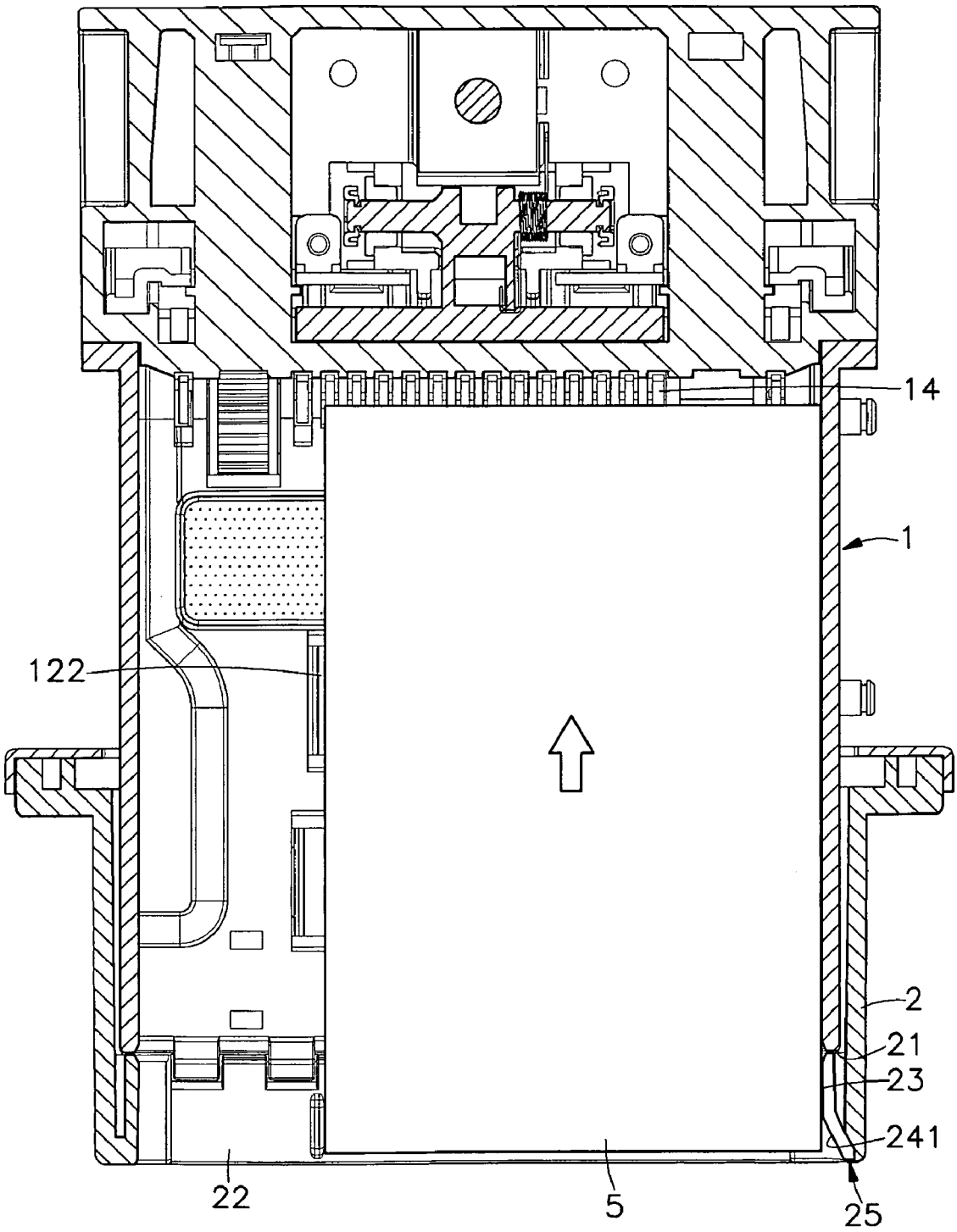
FIG. 7 is a schematic top view of the present invention, showing a license inserted through the insertion slot into the passage of the main body of the bill acceptor.
Figure 8:
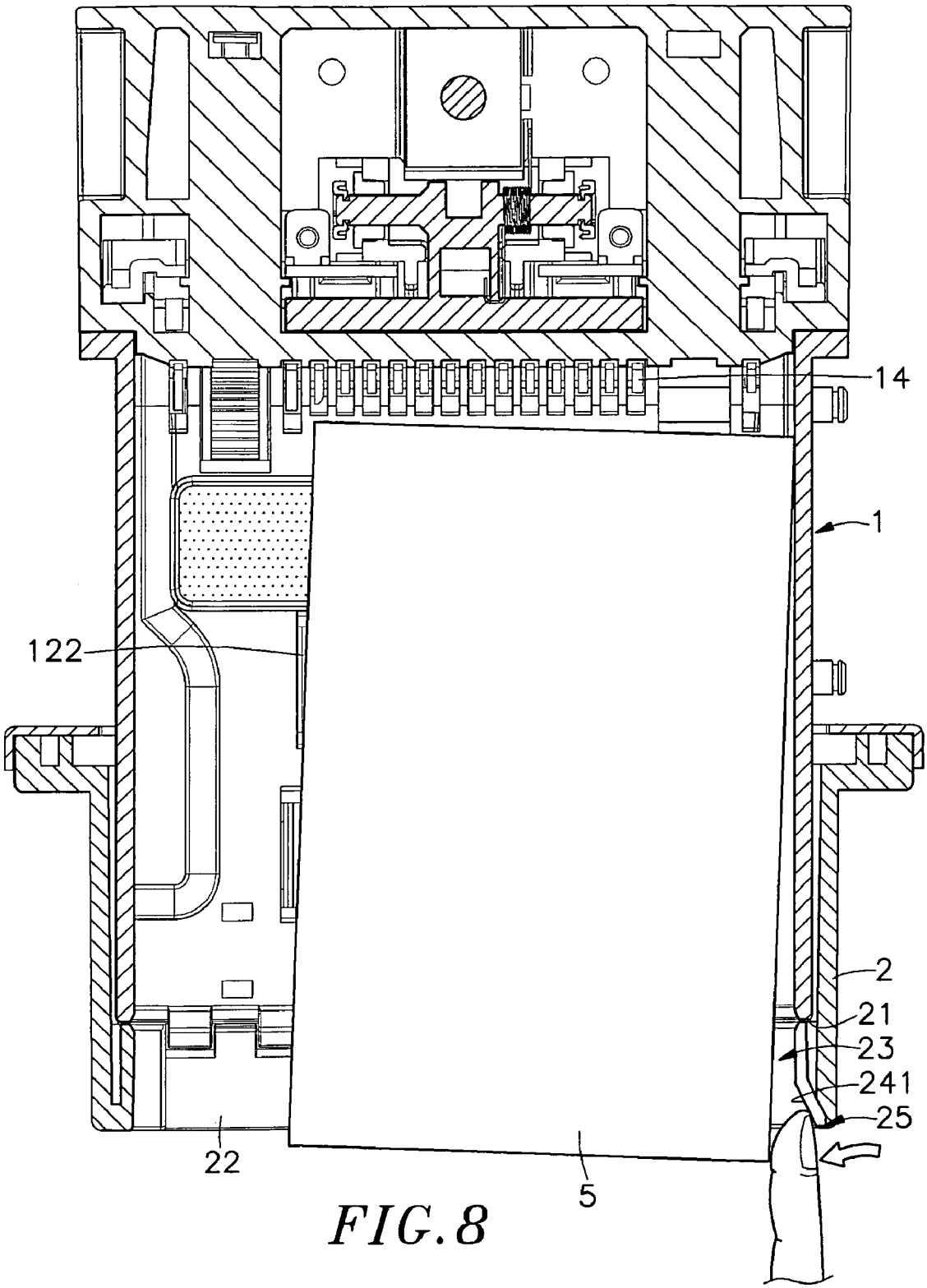
FIG. 8 is a schematic top view of the present invention, showing a finger inserted into the tapered finger groove and the jammed license biased toward the outside of the insertion slot.

Referring to FIGS. 6-8 and FIGS. 4 and 5 again, the guide frame 22 and the finger guide portion 24 can be molded from plastics in integrity through an injection molding process, and then the face panel 2 is molded on the molded device of the guide frame 22 and the finger guide portion 24 by means of over molding. After over molding, the face panel 2 is fastened to the front side of the main body 1, keeping the opening 21 of the face panel 2 in alignment with the passage 11 of the main body 1.

Except the process of directly molding the face panel 2 on the molded device of the guide frame 22 and the finger guide portion 24 by means of over molding, the guide frame 22 and the finger guide portion 24 could be molded from plastics in integrity and then fastened to the face panel 2 by means of engaging the two V-shaped locating ribs 221 of the guide frame 22 into the V-shaped locating grooves 211 of the face panel 2 respectively and then engaging the two retaining blocks 242 of the finger guide portion 24 into the retaining holes 232 of the face panel 2 respectively.

When the bill acceptor is assembled, the bill acceptor is installed in an automatic vending machine so that a user can insert a bill 4 or license 5 through the insertion slot 23 into the passage 11. When a bill 4 or license 5 entered the passage 11, the reversible motor 121 is started to drive the bill-transfer rollers 122 and the transmission belts 123, moving the inserted bill 4 or license 5 to a predetermined examination position in the passage 11 for examination by the recognition unit 13 to check the authenticity and value of the inserted bill 4, or to check the authenticity of the inserted license 5 and the birth date data on the inserted license 5.

When recognizing an inserted license 5, the sampling module 131 picks up the image of the license 5 and converts the image into a digital data, and then compares the digital data with a reference digital image data stored in a digital image database, thereby determining the authenticity of the license 5 and the age of the license holder for legal transaction. After the authenticity of the license 5 has been recognized and the age data on the license 5 has been checked over the legal age, the user is allowed to insert a bill 4 into the insertion slot 23 to start the transaction. According to the present invention, the user must insert a license 5 into the insertion slot 23 of the bill acceptor for recognition before transaction. A bill 4 can be inserted into the insertion slot 23 of the bill acceptor only after the user's identity and legal age status have been checked. Further, the aforesaid anti-theft hook 14 is arranged in the middle turn of the passage 11 to prohibit the evil persons from pulling back any received bills 4 out of the bill acceptor. Therefore, the invention assures high security.

Further, when a bill 4 entered the passage 11, the optical identification module 132 of the recognition unit 13 examines the anti-counterfeit characteristics and value of the bill 4. After examination, the reversible motor 121 is started again to drive the bill-transfer rollers 122 and the transmission belts 123, moving the bill 4 from the examination position to the rear end of the passage 11. Thereafter, the bill-pressing device 15 is operated to push the bill 4 transversely away from the passage 11 to the bill-bearing board 161 of the bill box 16 against the spring members 162, enabling the bill 4 to be held on the bill-bearing board 161 and received inside the bill box 16. The aforesaid transmission mechanism 12 and the recognition unit 13 are not the key points of the present invention, therefore no further detailed description in this regard is necessary.

Referring to FIGS. 4, 5, 7 and 8 again, by means of the arrangement of the guide frame 22 and the finger guide portion 24 in the opening 21 of the face panel 2, the invention eliminates the drawbacks of the installation of a push-push mechanism. As stated above, the tapered finger groove 241 defined in the finger guide portion 24 in communication with the insertion slot 23. When a license 5 is jammed in the insertion slot 23, the user can insert a finger into the tapered finger groove 241 to bias the license 5 toward the outside of the insertion slot 23, allowing retrieval of the jammed license 5. Therefore, the arrangement of the guide frame 22 and the finger guide portion 24 allows the user to retrieve the jammed license 5 directly with the hand without any tools.

Further, the aforesaid indicator 25 can be a pattern, color mark or word formed on the front side of the finger guide portion 24 by means of laser engraving, transfer printing or color etching. Further, the indicator 25 can be formed of a fluorescent material for providing light at night or under a dim environment. By means of the indication of the indicator 25, a user can insert a bill 4 or license 5 into the insertion slot 23 accurately. During insertion of a license 5 that has a width relatively smaller than a bill 4, the license 5 to be inserted is closely attached to one side edge of the insertion slot 23 and then pushed forwards toward the inside of the passage 11, allowing the inserted license 5 to be carried forward to the examination position for examination by the recognition unit 13.

As stated above, the guide frame 22 is fastened to the opening 21 of the face panel 2, defining the aforesaid insertion slot 23 within the opening 21 for the insertion of a bill 4 or license 5. The guide frame 22 can be a pattern, color mark or word formed on the front side (see FIG. 5) to guide the insertion of a license 5 in the correct direction with the anti-counterfeit characteristics and character data of the inserted license 5 facing upwards (or downwards) for accurate examination by the recognition unit 13, avoiding an examination error due to incorrect insertion of the direction (up or down) of the license 5. In the present invention, on the front side of the guide frame 22 is marked a direction arrow and two circular points with different color, but it is not limited.

Further, the guide frame 22 can be made out of a transparent or translucent material, or have a part transparent for the passing of light. Further, as stated above, the lighting module 3 is mounted in the main body 1 beneath the front side of the passage 11 corresponding to the guide frame 22. During operation of the bill acceptor in the dark, the light emitting device 31 emits light through the lens 32 toward the guide frame 22, thereby illuminating the area around the insertion slot 23. By means of the effect of the lens 32, light rays are concentrated at the guide frame 22, avoiding dazzling.

Further, the color of the light emitting device 31 matches the color of the guide frame 22. By means of the color indication of the light passing from the light emitting device 31 through the guide frame 22, the user can accurately insert a license 5 into the insertion slot 23 in the correct direction along the correct side edge of the insertion slot 23 toward the passage 11, avoiding an examination error.

As stated above, the invention provides a bill acceptor for automatic vending machine, which has the following features and advantages:

1. The finger guide portion 24 of the guide frame 22 is disposed one side of the insertion slot 23 of the face panel 2. When a license 5 is jammed in the insertion slot 23, the user can insert a finger into the tapered finger groove 241 of the finger guide portion 24 to bias the license 5 toward the outside of the insertion slot 23, allowing retrieval of the jammed license 5. Therefore, the arrangement of the guide frame 22 and the finger guide portion 24 allows the user to retrieve the jammed license 5 directly with the hand without any tools, simplifying troubleshooting.

2. The indicator 25 can be a pattern, color mark or word formed on the front side of the finger guide portion 24 to guide the insertion of a license 5 along one side of the insertion slot 23 toward the inside of the passage 11, allowing the inserted license 5 to be carried forward to the examination position for examination by the recognition unit 13. Further, the indicator 25 can be formed of a fluorescent material for providing light at night or under a dim environment.

3. The guide frame 22 can be colored with different colors to guide the insertion of a license 5 in the correct direction with the anti-counterfeit characteristics and character data of the inserted license 5 facing upwards (or downwards) for accurate examination by the recognition unit 13, avoiding an examination error due to incorrect insertion of the direction (up or down) of the license 5.

4. During operation of the bill acceptor, the light emitting device 31 of the lighting module 3 emits light through the lens 32 toward the guide frame 22, illuminating the area around the insertion slot 23. By means of the effect of the lens 32, light rays are concentrated at the guide frame 22, avoiding dazzling.

5. By means of the color indication of the light passing from the light emitting device 31 through the guide frame 22, the user can accurately insert a license 5 into the insertion slot 23 in the correct direction along the correct side edge of the insertion slot 23 toward the passage 11, avoiding an examination error.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A bill acceptor comprising:

a main body, said main body comprising a passage, a bill box attached to a rear end of said passage, a transmission mechanism controllable to move each inserted bill or license in and out of said passage and to move each examined bill to said bill box, and a recognition unit provided at top and bottom sides relative to said passage for identifying the authenticity and value of each inserted bill and the authenticity and character data of each inserted license; and a face panel fastened to a front side of said main body, said face panel comprising an insertion slot disposed in communication with said passage for the insertion of a bill/license into said passage, and a finger guide portion disposed within and at one lateral side of said insertion slot for the insertion of a finger to bias a jammed license out of said insertion slot.

2. The bill acceptor as claimed in claim 1, wherein said finger guide portion defines a tapered finger groove in communication with said insertion slot at one lateral side relative to said insertion slot for the insertion of a finger.

3. The bill acceptor as claimed in claim 1, wherein said face panel comprises an indicator formed on a front side of said finger guide portion to guide the insertion of a license along one lateral side of said insertion slot into said passage.

4. The bill acceptor as claimed in claim 3, wherein said indicator is molded on said finger guide portion, showing a different color relative to said finger guide portion.

5. The bill acceptor as claimed in claim 3, wherein said indicator is one of a pattern, a color mark and a word formed on said finger guide portion by means of one of the techniques of laser engraving, transfer printing and color etching.

6. The bill acceptor as claimed in claim 3, wherein said indicator is formed of a fluorescent material.

7. The bill acceptor as claimed in claim 1, wherein said face panel comprises an opening, a mounting groove disposed at one lateral side of said opening for the mounting of said finger guide portion, and a guide frame fastened to said opening and defining said insertion slot within said opening.

8. The bill acceptor as claimed in claim 7, wherein said face panel comprises two V-shaped locating grooves disposed at two opposite lateral sides relative to said opening; said guide frame comprises two V-shaped locating ribs respectively engaged into said V-shaped locating grooves.

9. The bill acceptor as claimed in claim 7, wherein said face panel comprises two retaining holes disposed adjacent to said mounting groove at different elevations; said finger guide portion comprises two retaining blocks respectively engaged into said retaining holes.

10. The bill acceptor as claimed in claim 1, wherein said face panel comprises an opening, a mounting groove disposed at one lateral side of said opening for the mounting of said finger guide portion, and a guide frame fastened to said opening and defining said insertion slot within said opening; said main body comprises a lighting module corresponding to said guide frame and adapted for emitting light toward said guide frame.

11. The bill acceptor as claimed in claim 10, wherein said lighting module comprises at least one light emitting device.

12. The bill acceptor as claimed in claim 11, wherein said at least one light emitting device is a predetermined color of high brightness light emitting diode and laser light emitting diode.

13. The bill acceptor as claimed in claim 10, wherein said lighting module further comprises a lens set between said at least one light emitting device and said guide frame.

14. The bill acceptor as claimed in claim 10, wherein said guide frame can be made out of a transparent and translucent material with at least one color, or have a part transparent for the passing of light, and can be a pattern, color mark and word formed on the front side.

15. The bill acceptor as claimed in claim 1, wherein said transmission mechanism is comprised of a reversible motor, a set of bill-transfer rollers and transmission belts driven by said reversible motor.

16. The bill acceptor as claimed in claim 1, wherein said recognition unit comprises a sampling module adapted for reading and identifying anti-counterfeit characteristics and character data of a license, and an optical identification module adapted for identifying the authenticity and value of a bill.

17. The bill acceptor as claimed in claim 1, wherein said main body further comprises a bill-pressing device disposed at one side of the rear end of said passage opposite to said bill box and adapted for moving a bill out of said passage into the inside of said bill box.

18. The bill acceptor as claimed in claim 1, wherein said finger guide portion allows access of said finger to reach a side of said jammed license.

* * * * *